US005433582A

United States Patent [19]

Medina

[11] Patent Number: 5,433,582

[45] Date of Patent: Jul. 18, 1995

[54] DEVICE FOR DISCHARGING PAPERS

[76] Inventor: Pete R. Medina, 9860 SW. 4th St., Plantation, Fla. 33324

[21] Appl. No.: 260,276

[22] Filed: Jun. 14, 1994

[51] Int. Cl.[6] ..... B65G 57/06

[52] U.S. Cl. ..... 414/788.3; 198/726; 198/813; 414/790.3; 414/900

[58] Field of Search ..... 198/813, 814, 815, 816, 198/726; 414/789, 790.3, 788.3, 900

[56] References Cited

U.S. PATENT DOCUMENTS 4,718,807 1/1988 Baxter .
4,749,077 6/1988 Sjogren .

*Primary Examiner*—Michael S. Huppert
*Assistant Examiner*—Janice L. Krizek
*Attorney, Agent, or Firm*—J. Sanchelima

[57] ABSTRACT

A device for stacking papers having a disk with a top and bottom surface, a means for rotating the disk, a pair of symmetrically opposing movable walls having opposing longitudinal flat wall sections that are kept in a parallel space apart relationship. The opposing fiat wall sections and the top surface of the disk defining a first space adapted to receive the papers, and the interior of said symmetrically opposing movable walls and the top surface of the disk defining a second space adapted to contain the assembly for turning the opposing movable walls. The movement of the opposing movable walls discharging the papers that have been deposited in the first space of the device. The device also includes tensioners that keep the symmetrically opposing movable walls taut and are positioned so that the tensioners do not alter the parallel spaced apart relationship of the opposing longitudinal fiat wall sections. In addition, the symmetrically opposing movable walls are mounted to the top surface of the disk on slots so that they can be adjusted to collect, and discharge, papers of greater or less length.

4 Claims, 4 Drawing Sheets

DEVICE FOR DISCHARGING PAPERS

BACKGROUND OF THE INVENTION

1. Field of the Invention

The present invention relates to devices for stacking papers, and more particularly, to a novel apparatus for stacking, forming and discharging compensated, or uncompensated, bundles of papers.

2. Description of the Related Art

Applicant believes that the closest reference corresponds to U.S. Pat. No. 4,749,077 issued to Sjogren. However, it differs from the present invention because the Sjogren device has external drive motors mounted below the stacking surface and a complicated mechanism for discharging the newspaper bundles from the device. One of the drawbacks of Sjogren is that to adjust the tension of the moving wall means, the straight section of the movable walls is affected. Also, the movable wall means, in Sjogren, can not readily be adjusted to handle newspapers having greater or lesser length between the cut and folded edges of the newspaper.

Other patents describing the closest subject matter provide for a number of more or less complicated features that fail to solve the problem in an efficient and economical way. None of these patents suggest the novel features of the present invention.

SUMMARY OF THE INVENTION

It is one of the primary objects of the present invention to provide a device which will stack and discharge paper bundles.

It is another object of the present invention to provide a device which can readily be removed from a larger apparatus for processing bundles of papers and replaced, with minimal effort, by another device.

It is yet another object of the present invention to provide a track assembly with flexible panels that are interlinked such that the clothing or appendages of a user cannot be caught between the flexible panels while the present invention is operating.

It is still another object of this invention to provide a device which has a drive assembly contained by its track assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
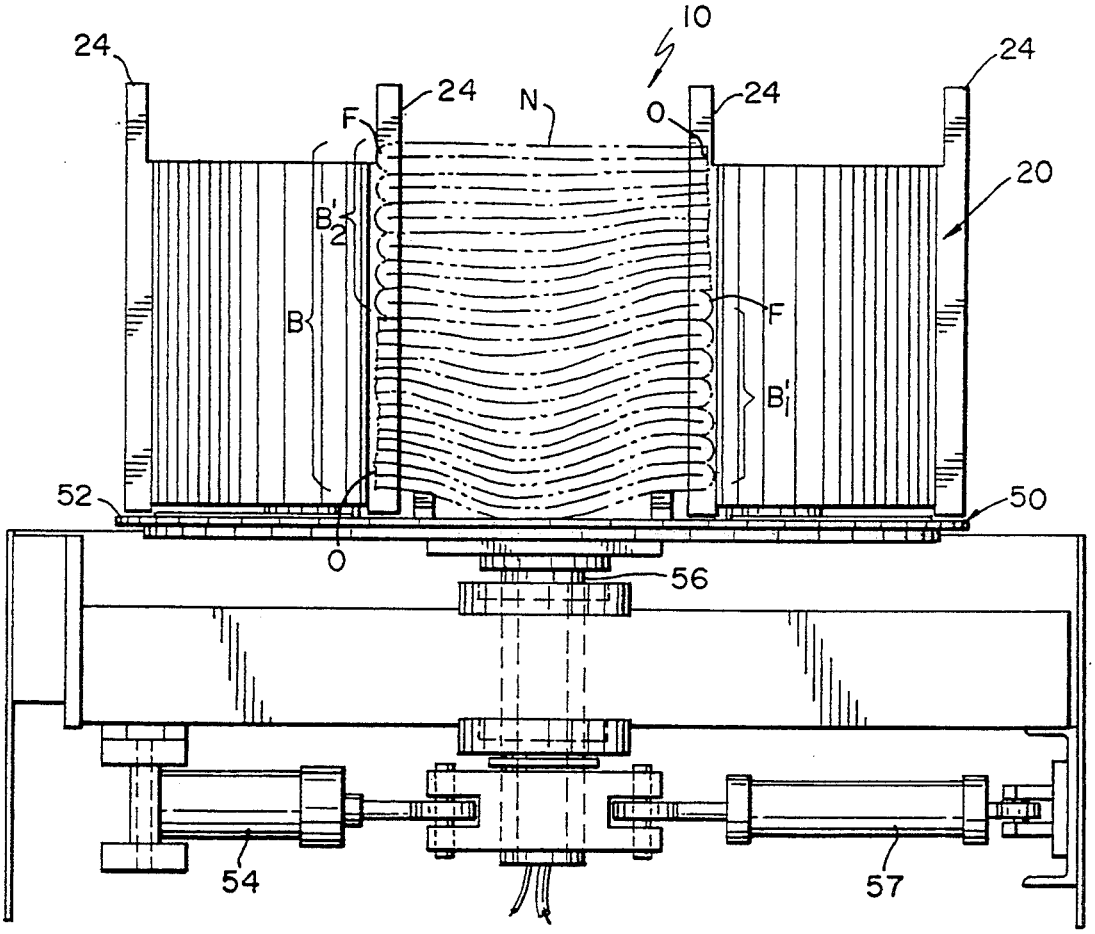
FIG. 1 represents a side view of the present invention.

Referring now to the drawings where the present invention is generally referred to with numeral 10, it can be observed that it basically includes track assembly 20, drive assembly 30 and turntable assembly 50.

Referring now to FIG. 1, it can be seen that device 10 forms compensated, or uncompensated, bundles of newspapers N, or similar paper products. Newspapers N are dropped between the side walls 20' and 20', of device 10, by a signature stacking apparatus, such as the one found in U.S. Pat. No. 4,718,807, issued to Michael S. Baxter on Jan. 12, 1988. However, a number of similar stackers can drop newspapers N into device 10. Baxter is only representative of the type of equipment that may be utilized.

Figure 2:
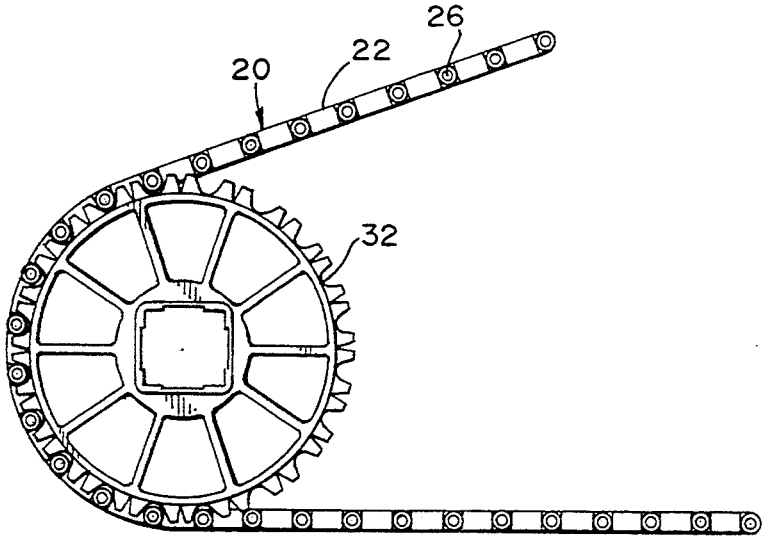
FIG. 2 is a representation of a partial view of the track assembly.
Figure 4:
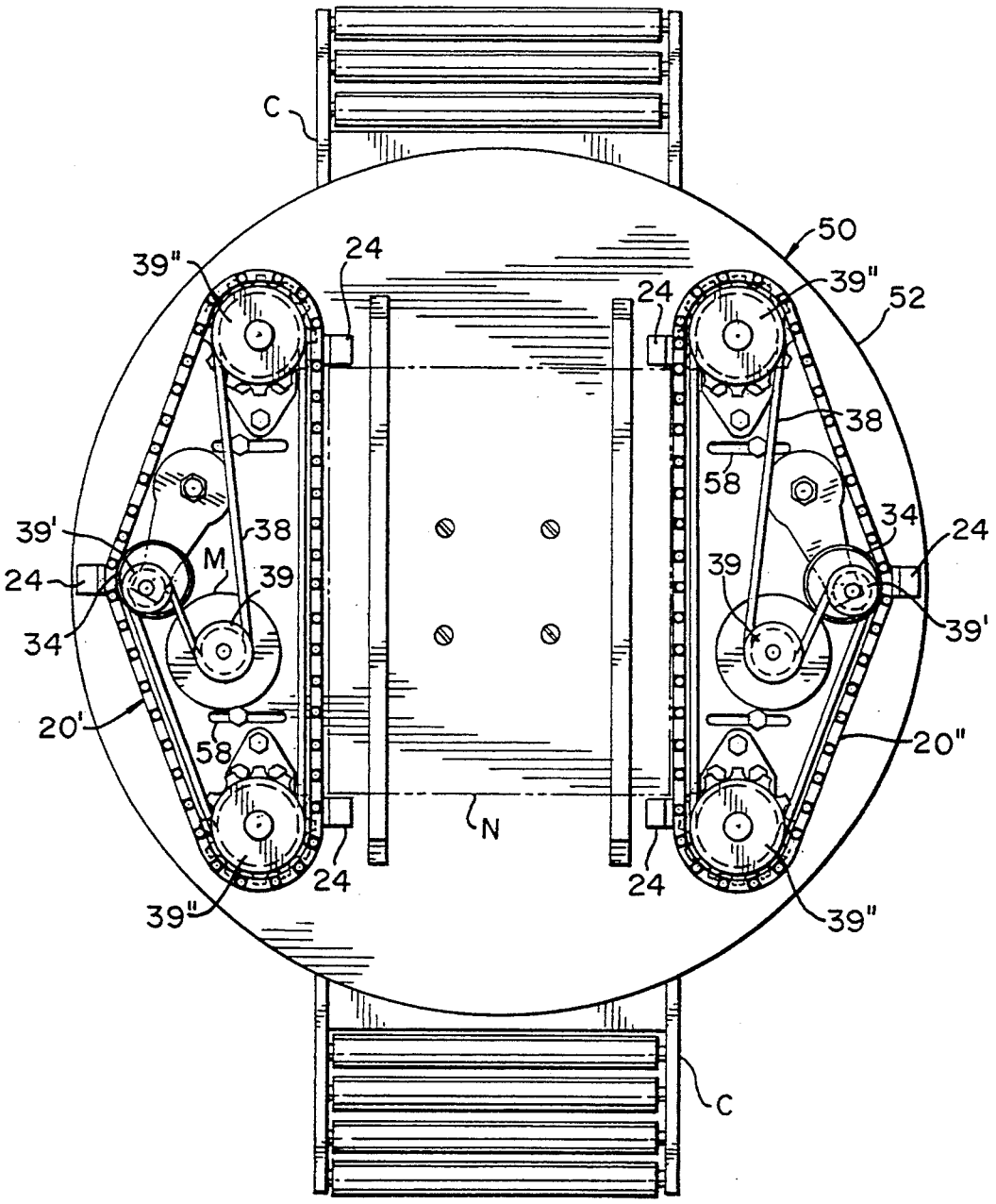
FIG. 4 shows a top view of the present invention.

Particularly referring now to FIGS. 2 and 4, it can be seen that track assembly 20 comprises flexible panels 22, pusher bars 24, rods 26 and home sensor 28. Flexible panels 22 are flexibly, and demountably, interlinked by rods 26. It can also be seen in FIG. 2, that track assembly 20 meshes with the teeth of sprockets 32. Referring again to FIG. 4, it is apparent that the rotation of sprockets 32 causes track assembly 20 to turn and that the faces of side walls 20' and 20'' are formed by flexible panels 22. Also, rods 26 interlink flexible panels 22 and permit a user to readily remove and replace track assembly 20.

Figure 3:
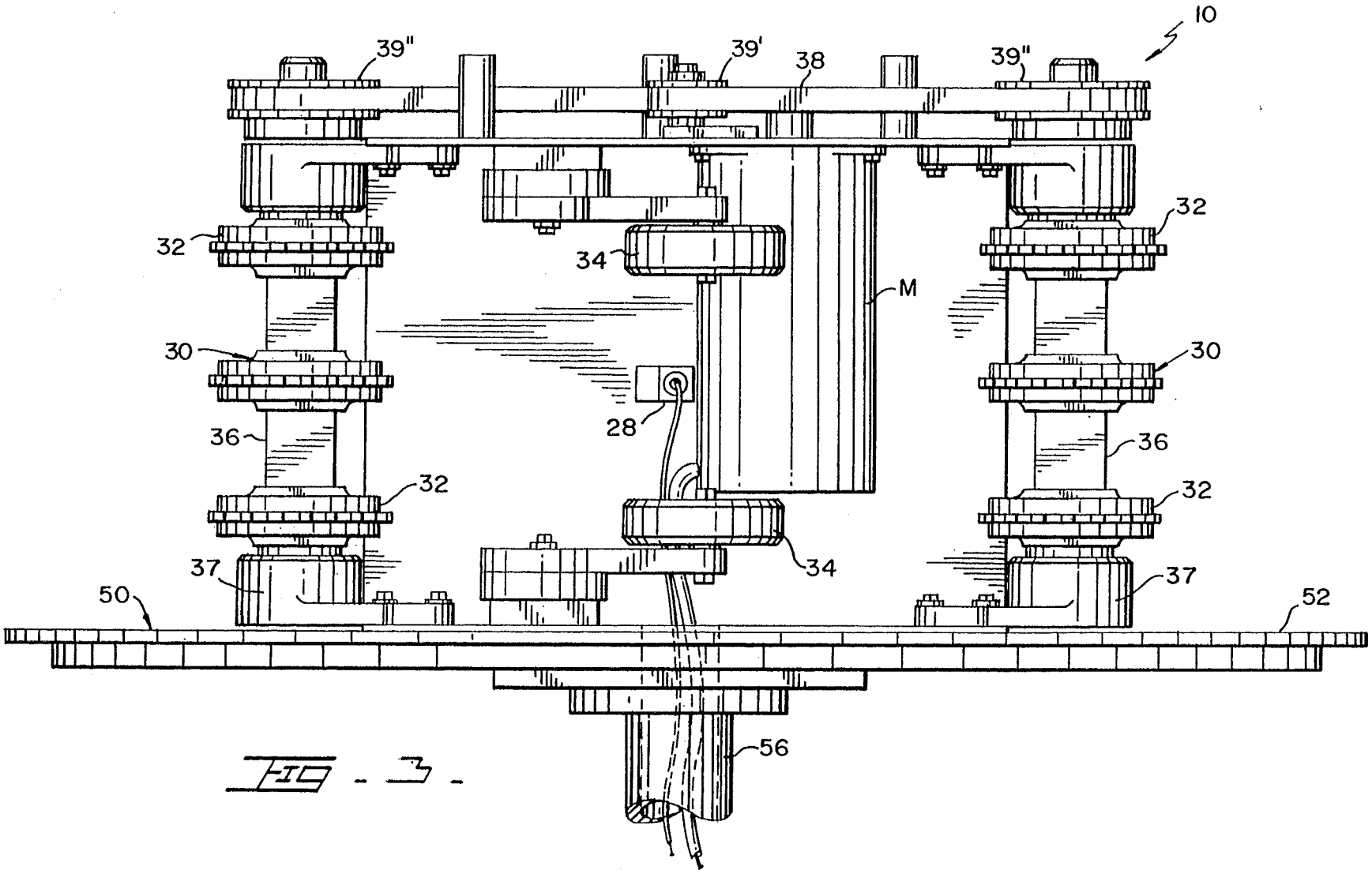
FIG. 3 shows a lateral view of the drive assembly, with the track assembly removed.

Referring now to FIGS. 2, 3 and 4, it can be seen that drive assembly 30 comprises sprockets 32, tensioners 34, shafts 36, belt 38, wheels 39 and motor M. Referring now to FIGS. 3 and 4, it can be seen that sprockets 32 are mounted on shafts 36 and cooperatively support and translate track assembly 20. When motor M is energized, wheel 39 rotates. The rotation of wheel 39 translates belt 38 which in turn rotates wheels 39'. The rotation of wheels 39'' turns shafts 36. Idler wheel 39' maintains sufficient tautness in belt 38 to rotate wheels 39, 39' and 39'. Sprockets 32 and tensioners 34 cooperatively align track assembly 20 such that when Motor M is energized, pusher paddles 24 push newspapers N off disk 52 and onto conveyor C, or a similar mechanism for processing newspapers N. In the preferred embodiment, pusher paddles 24 are disposed on flexible panels 22 such that pusher paddles 24 are equidistant to one another along both first side wall 20' anti second side wall 20'' of track assemblies 20. In addition, pusher paddles 24, and flexible panels 22, move the same distance each time motor M is energized.

Turning now to FIGS. 1 and 4, it is apparent that device 10 receives newspapers N, from a signature stacker or similar device, and these newspapers N are deposited in the area defined by first and second side walls 20' and 20'' and disk 52. A typical signature stacker deposits newspapers N in batches B'. A batch B' is one or more newspapers N with their folded edges F facing the same direction. In this disclosure two batches labeled $B'_1$ and $B'_2$ can be seen in FIG. 1. In general, batches are indicated with the character B'. As seen in FIG. 1, Batch $B'_1$ has its folded edges F all facing side wall 20'. The individual newspapers N, of batch $B'_1$ may be deposited by the signature stacker as a group, or individually. In addition, a user may elect to form batches B' from one or more newspapers N. For example, as seen in FIG. 1, the user has elected to have batch B' comprise seven newspapers N. After the signature stacker has deposited batch $B'_1$ into device 10, and after all odd numbered batches B', disk 52, of turntable assembly 53, rotates 180 degrees. As seen in FIG. 1, a bundle B is formed from one or more batches B'. A compensated bundle is formed by rotating disk 52 after each odd numbered batch B' is deposited on disk 52.

Among the problems overcome by device 10 is the tendency of folded newspapers to stack unevenly. This uneven stacking is caused by the folded edge F of newspaper N being slightly thicker than the opposing side O that does not have a fold. When only a few newspapers N are being processed the slight difference in thickness does not affect the way in which they are handled. However, when a number of newspapers N are stacked the slightly greater thickness of folded edge F causes bundle B to stack unevenly. To alleviate this problem newspapers N may be stacked in a compensated bundle.

As can best be seen in FIGS. 1, 2, 3 and 5, it is apparent that once a sufficient number of newspapers have been stacked to form a bundle B, that drive assembly 30 activates and sprockets 32, tensioners 34, shaft 36, drive chain 38 and wheels 39 cooperatively move track assembly 20, which in turn propels newspapers N off disk 52 and into a receptacle suitable for receiving newspapers N, or a conveyor belt C, which in turn carries newspapers N away from device 10. Drive assembly 30 is de-activated when one of three slugs (not shown), that are positioned equidistant along the length of side walls 20' and 20', pass in front of home sensor 28. Because the slugs are positioned equidistant along side walls 20' and 20', pusher paddles 24 translate an equal distance each time motor M is energized. The slugs are positioned along side walls 20' and 20'' such that pusher paddles 24 are disposed to contact the sides of newspaper N, that have been deposited in device 10, as best seen in FIGS. 1 and 4. It can also be seen that pusher paddles 24 also prevent newspapers N, or any inserts that are contained in newspapers N from sliding off disk 52. Device 10 may also form uncompensated bundles, when uncompensated bundles are formed disk 52 does not rotate.

As best seen in FIG. 3, motor M is suspended above disk 52. Because motor M is internally mounted, as opposed to being mounted below disk 52, as typically found in the relevant art, device 10 can more readily be removed from, and incorporated into, a larger machine for processing papers. Another important advantage of the present invention is the ease of adjusting device 10 to receive newspapers N of different sizes. Side walls 20' and 20'; not shown in FIG. 3, but best seen in FIGS. 1 and 4, may be adjusted to accommodate newspapers N of greater or lesser length by changing their positions in slots 58. Other inventions that have motors that are positioned below the rotating surface that is equivalent to disk 52 cannot be as readily repositioned because the connections between the motors and the assembly that rotates the side wall assemblies are on the lower and upper surfaces of the rotating surface respectively. In addition, the linkages that connect the motors and the drive assemblies must be adjusted to compensate for the increased, or decreased, distance between the motor and the drive assembly. If the distance is increased, the linkages must be lengthened, if the distance is decreased, the linkages must be shortened. These changes are not required to adjust the positions of side walls 20' and 20'. Also, side walls 20' and 20'' may be readily removed from device 10 because motors M are located above disk 52 and contained by drive assembly 30.

Figure 5:
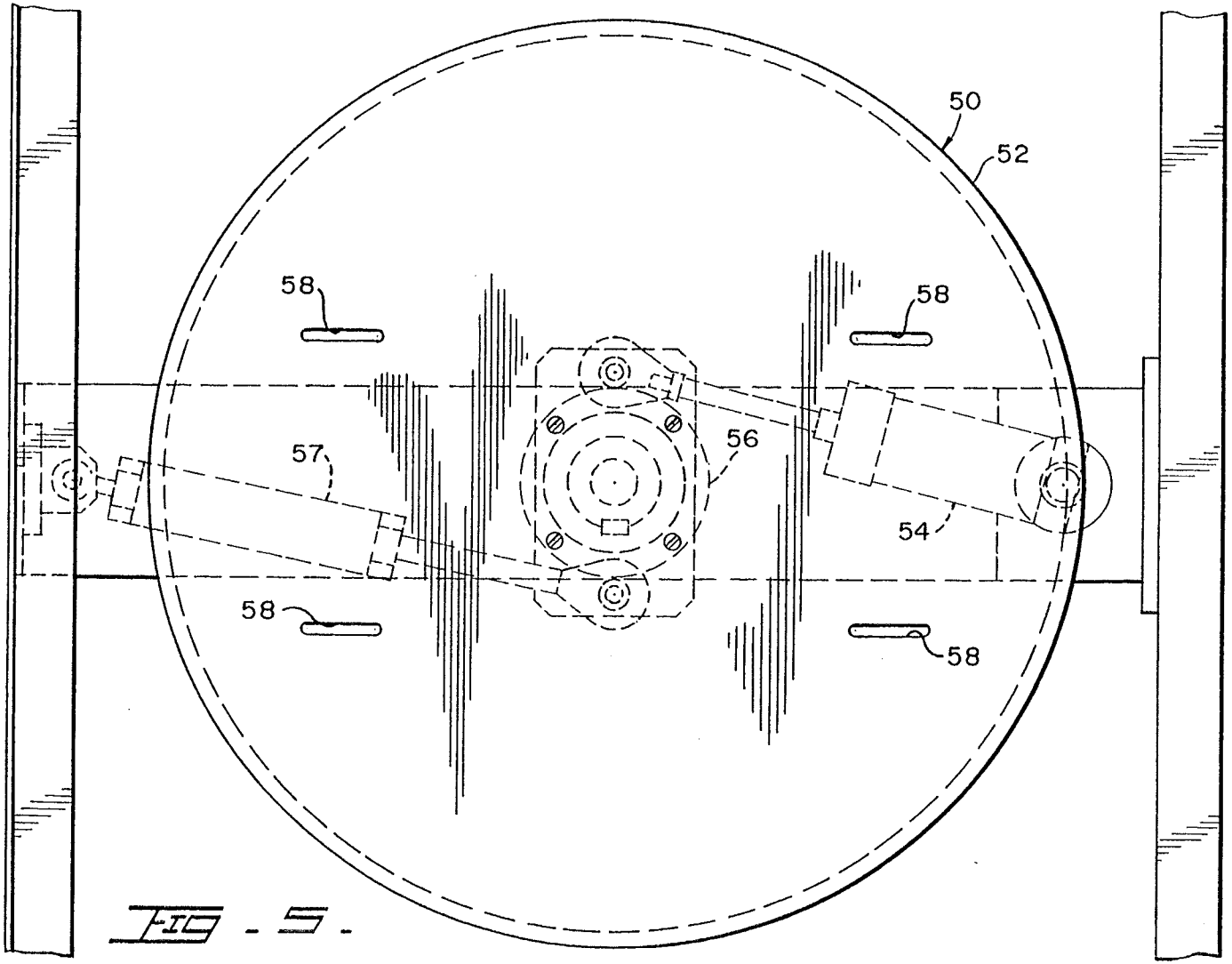
FIG. 5 depictors a top view of the turntable assembly.

Referring now to FIGS. 3 and 5, it can be seen that turntable assembly 150 comprises disk 152, air cylinder 154 column 156, shock absorber 157 and slots 158. Typically, disk 152 rotates after each batch B' is dropped into device 10. Disk 152 is positioned on the top of column 156 and column 156 is reciprocally rotated, by air cylinder 154, in order to form a compensated stack. It is also apparent that side walls 20' and 20'' are cooperatively and adjustably fastened to disk 152 by bases 37. The relative positions of side walls 20' and 20'' can be adjusted by repositioning bases 37 along slots 158 of disk 152. A user desiring to process a longer newspaper N, ie. a newspaper with a greater distance from cut edge to folded edge, would move side wall 20' and 20'' further apart, and a user processing a shorter paper, ie. a newspaper with a lesser distance from cut edge to folded edge, would move side walls 20' and 20'' closer together.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for stacking papers comprising:

A. a disk means having a top and bottom surface wherein said disk means further includes slot means;

B. means for reciprocally rotating said disk means 180 degrees after a pre-selected number of said papers have been deposited on said disk means;

C. a pair of symmetrically opposing movable wall means having interior and exterior faces, each of said symmetrically opposing movable wall means having an opposing longitudinal fiat wall section, said opposing longitudinal fiat wall sections are kept in a parallel spaced apart relation and said opposing longitudinal fiat wall sections; and said top surface of said disk means defining a first space adapted to receive said papers, said symmetrically opposing movable wall means mounted to said disk means, said interior face of said symmetrically opposing movable wall means and said top surface of said disk means defining a second space, and said symmetrically opposing movable wall means being removably mounted to said slot means thereby permitting the position of said symmetrically opposing movable wall means to be adjusted to accommodate said papers of different lengths;

D. means for selectively moving said symmetrically opposing movable wall means such that said papers are discharged from said first space;

E. tensioning means for keeping said symmetrically opposing movable side wall means taut, said tensioning means being positioned in the interior of said second space and disposed so that said tensioning means does not alter the parallel spaced apart relationship of said opposing longitudinal flat wall sections.

2. A device for stacking papers as in claim 1, wherein said means for selectively moving said symmetrically opposing movable wall means comprises;

A. a motor means;

B. sprocket means for moving said symmetrically opposing movable wall means, the rotation of said sprocket means moving said symmetrically opposing movable wall means such that said papers are discharged from said first space;

C. a shaft means for rotating said sprocket means;

D. belt means for turning said shaft means, said motor means propelling said belt means and thereby rotating said shaft means, the rotation of said shaft means turning said sprocket means.

3. A device for stacking papers as in claim 2, wherein said motor means, said sprocket means, said shaft means and said belt means are contained in said second space of said symmetrically opposing movable wall means.

4. A device for stacking papers as in claim 3, wherein said means for selectively moving said symmetrically opposing movable wall means further comprises a home sensor means, said home sensor means deactivating said motor means after said symmetrically opposing movable wall means have discharged said papers from said first space of said symmetrically opposing movable wall means.

* * * * *